US008292038B2

(12) United States Patent
McCarthy et al.

(10) Patent No.: US 8,292,038 B2
(45) Date of Patent: Oct. 23, 2012

(54) CONTROL DEVICE FOR OPERATING TWO ELEVATOR CARS IN A SINGLE HOISTWAY

(75) Inventors: Richard C. McCarthy, Niantic, CT (US); Greg A. Schienda, Plantsville, CT (US); Harold Terry, Avon, CT (US)

(73) Assignee: Otis Elevator Company, Farmington, CT (US)

( * ) Notice: Subject to any disclaimer, the term of this patent is extended or adjusted under 35 U.S.C. 154(b) by 303 days.

(21) Appl. No.: 12/742,261

(22) PCT Filed: Dec. 5, 2007

(86) PCT No.: PCT/US2007/086448

§ 371 (c)(1),
(2), (4) Date: May 11, 2010

(87) PCT Pub. No.: WO2009/073025

PCT Pub. Date: Jun. 11, 2009

(65) Prior Publication Data

US 2010/0270109 A1 Oct. 28, 2010

(51) Int. Cl.
*B66B 1/28* (2006.01)

(52) U.S. Cl. ..... 187/249; 187/391

(58) Field of Classification Search ..... 187/247, 187/248, 249, 277, 287, 288, 293, 391–394
See application file for complete search history.

(56) References Cited

U.S. PATENT DOCUMENTS 849,840 A 4/1907 Foster
974,439 A 11/1910 Schwab
1,027,628 A 5/1912 Schwab
1,370,111 A 3/1921 Jackson, Jr.
1,805,227 A 5/1931 Rugg
1,896,776 A 2/1933 James (Continued)

FOREIGN PATENT DOCUMENTS

EP 1235323 A1 8/2002

(Continued)

OTHER PUBLICATIONS

International Preliminary Report on Patentability for International application No. PCT/US2007/086448 mailed Jun. 17, 2010.

(Continued)

*Primary Examiner* — Anthony Salata

(74) *Attorney, Agent, or Firm* — Carlson, Gaskey & Olds PC

(57) ABSTRACT

The device for controlling movement of a plurality of elevator cars in a single hoistway includes a door monitor module (46) that facilitates controlling movement of elevator cars (22, 24). The door monitor module (46) is configured to determine when at least one door (30) along a hoistway (26) is open. The door monitor module (46) places a first relay (52) in a selected operative state if a first elevator car (22) is stopped at a landing corresponding to the at least one open door. The door monitor module (46) places a second relay (56) in a selected operative state if a second elevator car (24) is stopped at a landing corresponding to the at least one open door. The door monitor module (46) is also configured to place both relays (52, 56) into the selected operative state if neither of the elevator cars (22, 24) is stopped at a landing corresponding to an open door (30) along a hoistway (26).

14 Claims, 1 Drawing Sheet

U.S. PATENT DOCUMENTS

| | | | | |
|---|---|---|---|---|
| 1,896,777 | A | 2/1933 | James | |
| 1,920,369 | A | 8/1933 | Ellis, Jr. | |
| 1,973,920 | A | 9/1934 | Wilson | |
| 3,461,422 | A | 8/1969 | Hansen | |
| 4,516,666 | A | 5/1985 | Sheill | |
| 5,107,964 | A | 4/1992 | Coste et al. | |
| 5,419,414 | A * | 5/1995 | Sakita | 187/391 |
| 5,663,538 | A | 9/1997 | Sakita | |
| 5,865,274 | A | 2/1999 | Kiji et al. | |
| 5,877,462 | A | 3/1999 | Chenais | |
| 6,273,217 | B1 | 8/2001 | Hikita | |
| 6,360,849 | B1 | 3/2002 | Hikita | |
| 6,364,065 | B1 | 4/2002 | Hikita | |
| 6,554,107 | B2 | 4/2003 | Yumura et al. | |
| 6,619,437 | B2 * | 9/2003 | Hikita | 187/383 |
| 6,758,319 | B1 * | 7/2004 | Lange et al. | 198/323 |
| 7,032,716 | B2 | 4/2006 | Meyle et al. | |
| 7,117,979 | B2 | 10/2006 | Angst et al. | |
| 7,178,635 | B2 * | 2/2007 | Meissner et al. | 187/249 |
| 7,353,914 | B2 * | 4/2008 | Deplazes | 187/313 |
| 7,448,471 | B2 * | 11/2008 | Nuebling | 187/286 |
| 7,487,860 | B2 * | 2/2009 | Hikita et al. | 187/249 |
| 7,819,228 | B2 * | 10/2010 | Terry et al. | 187/249 |
| 2002/0117358 | A1 | 8/2002 | Schoppa et al. | |
| 2005/0082121 | A1 | 4/2005 | Deplazes | |
| 2005/0087402 | A1 | 4/2005 | Haegi et al. | |
| 2005/0279584 | A1 | 12/2005 | Reuter et al. | |
| 2006/0175135 | A1 | 8/2006 | Meissner et al. | |
| 2006/0289240 | A1 | 12/2006 | Sakita | |
| 2007/0039785 | A1 | 2/2007 | Smith et al. | |

FOREIGN PATENT DOCUMENTS

| | | | |
|---|---|---|---|
| EP | 1371596 | A1 | 12/2003 |
| EP | 1698580 | A1 | 9/2006 |
| JP | 4345486 | | 12/1992 |
| JP | 4361960 | | 12/1992 |
| JP | 5051185 | | 3/1993 |
| Jp | 5132257 | | 5/1993 |
| JP | 6305648 | | 11/1994 |
| JP | 8133611 | | 5/1995 |
| JP | 7157243 | | 6/1995 |
| JP | 7172716 | | 7/1995 |
| JP | 8133630 | | 5/1996 |
| JP | 9110316 | | 4/1997 |
| JP | 2000128453 | | 5/2000 |
| JP | 2001226050 | | 8/2001 |
| JP | 2001240318 | | 9/2001 |
| JP | 2001247265 | | 9/2001 |
| JP | 2001251188 | | 9/2001 |
| JP | 2001335244 | | 12/2001 |
| JP | 2002220164 | | 8/2002 |
| JP | 2002255460 | | 9/2002 |
| JP | 2003160283 | | 6/2003 |
| JP | 2004010272 | | 1/2004 |
| JP | 2004155519 | | 6/2004 |
| WO | 2004096690 | A1 | 11/2004 |

OTHER PUBLICATIONS

International Search Report and Written Opinion of the International Searching Authority for International application No. PCT/US2007/086448 mailed Jul. 29, 2008.

Extract from European Standard EN81-1:1998 ("Safety Rules for the Construction and Installation of Lifts, Electric Lifts"), pp. 39, 42, 50, 88, 92, 96, 106 (Undated).

* cited by examiner

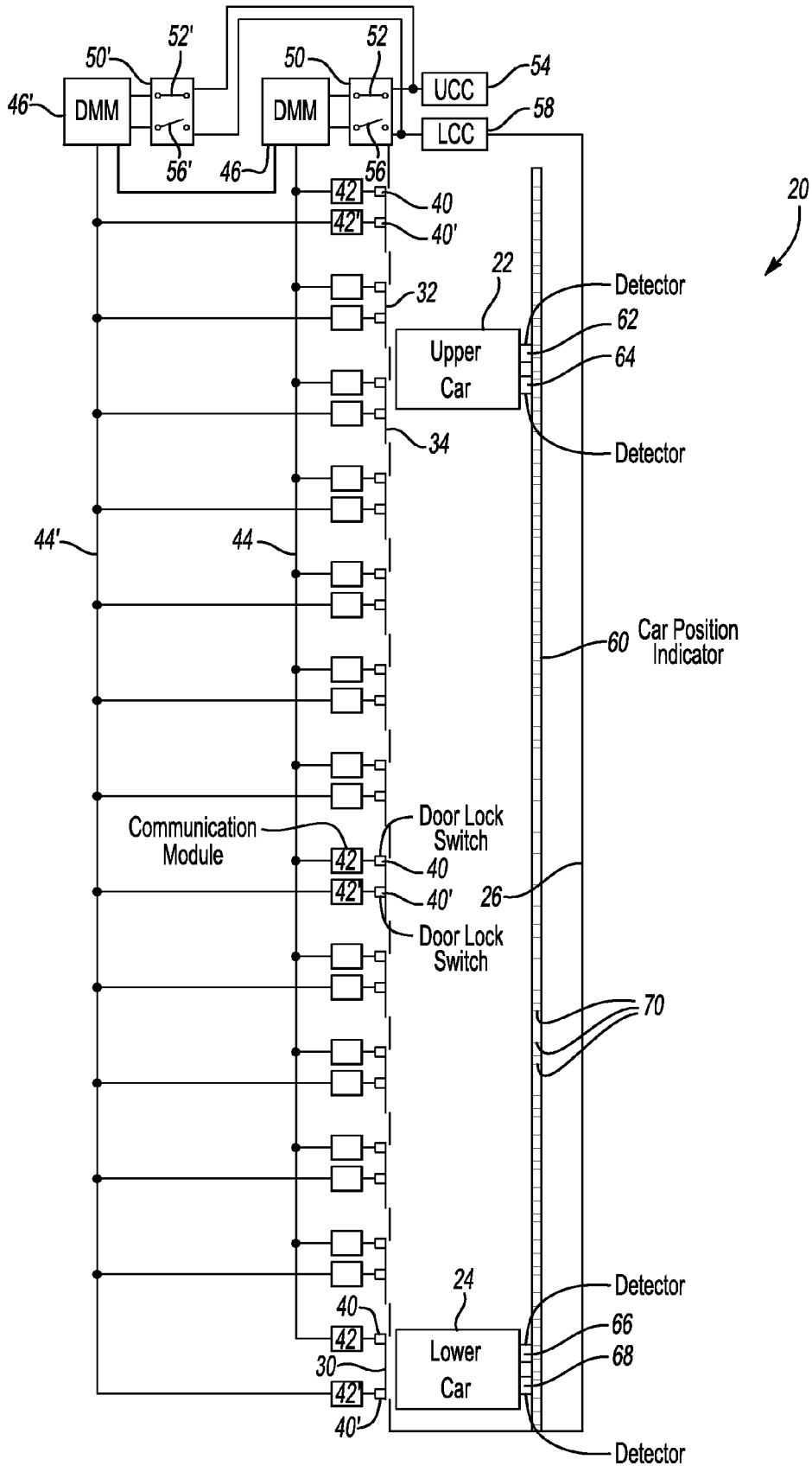
DMM
DMM
UCC
LCC
Upper Car
Lower Car
Detector
Detector
Detector
Detector
Car Position Indicator
Communication Module
Door Lock Switch
Door Lock Switch
20
22
24
26
30
32
34
40
40'
42
42'
44
44'
46
46'
50
50'
52
52'
54
56
56'
58
60
62
64
66
68
70

CONTROL DEVICE FOR OPERATING TWO ELEVATOR CARS IN A SINGLE HOISTWAY

BACKGROUND

Elevator systems most commonly include a single elevator car within a hoistway. It has been proposed to include two elevator cars within a single hoistway. While such a proposal can be found in the patent literature dating back many years, it has been uncommon to implement such a system. There are various challenges associated with attempting to include two elevator cars within a single hoistway.

For example, it is necessary to address the situation where a hoistway door is open. In traditional, one elevator car systems, a safety chain is installed along the hoistway. A door lock at each hoistway door is associated with a relay switch along the safety chain. When all of the doors are closed, all of the relay switches are also closed. The elevator car is permitted to run provided that all of the relay switches are closed, which indicates that all of the doors are closed. Whenever one of the doors opens, the corresponding relay switch contacts open, which interrupts the safety chain circuit. Under such circumstances, the elevator car is not permitted to move.

When two elevator cars are introduced into a single hoistway, it would be undesirable to stop both elevator cars in the event that a hoistway door is open for servicing a passenger on one of the elevator cars. If the traditional, one elevator car approach were used, any time the safety chain circuit were interrupted, both cars would have to stop. A better solution would be to allow one of the cars to continue moving while the other is stopped at the location of an open door.

One proposed arrangement to address this issue is shown in United States Patent Application Publication No. US 2005/0082121. That document discloses an arrangement where a safety control determines elevator car position data and door lock data and then establishes shaft regions in which each elevator car is safely movable based on that data. Another approach is shown in U.S. Patent Application Publication No. U.S. 2006/0175135. That document includes using two independent safety circuits, one for each of the elevator cars. While each of these proposals theoretically allow for one elevator car to continue moving while the other is stopped within the same hoistway, those skilled in the art are always striving to make improvements. It would be beneficial to provide a less complicated and less expensive solution that allows for controlling two elevator cars within a single hoistway in the event that a hoistway door is open.

SUMMARY

An exemplary device for controlling two elevator cars within an elevator hoistway includes a door monitor module that facilitates controlling movement of elevator cars. The door monitor module is configured to determine when at least one door along a hoistway is open. The door monitor module places a first relay in a selected operative state if a first elevator car is stopped at a landing corresponding to the open door. The door monitor module places a second relay in a selected operative state if a second elevator car is stopped at a landing corresponding to the at least one open door. The door monitor module is also configured to place both relays into the selected operative state if neither of the elevator cars is stopped at a landing corresponding to an open door along a hoistway.

The various features and advantages of the disclosed examples will become apparent to those skilled in the art from the following detailed description. The drawings that accompany the detailed description can be briefly described as follows.

BRIEF DESCRIPTION OF THE DRAWINGS

FIG. 1 schematically illustrates selected portions of an elevator system including an example embodiment of this invention.

DETAILED DESCRIPTION

FIG. 1 schematically illustrates selected portions of an elevator system 20. A first elevator car 22 and a second elevator car 24 are each situated for movement within a single hoistway 26. In this example, the first elevator car 22 can be considered an upper car because it is vertically above the second elevator car 24, which can be referred to as a lower car.

The hoistway 26 includes a plurality of hoistway doors that operate in a known manner to provide access to the hoistway 26. In the illustrated example, the lower car 24 is stopped at a landing corresponding to one of the doors 30 to provide service to a passenger at that building level. The upper car 22 is moving and is currently between the doors 32 and 34 as schematically shown. It is possible for the upper car 22 to continue moving within the hoistway 26 even though the door 30 is open to provide access to the lower car 24. The illustrated example includes a device for controlling movement of the elevator cars 22 and 24 that allows for such operation.

Each door includes a door lock switch 40 that operates in a known manner to provide an indication of when the door lock of the associated door has been opened. An open door lock is used in some examples as an indication of an open door. Whenever one of the doors that provide access to the hoistway 26 is unlocked, it is considered to be an open door, which indicates a situation where elevator car movement may be undesirable.

In the illustrated example, each door lock switch 40 is associated with a communication module 42 that provides an indication of the condition of the associated door lock. Each of the communication modules 42 communicates over a communication link 44 with a door monitor module (DMM) 46. In one example, the communication link 44 comprises a serial data bus. Example communication links 44 facilitate communications using remote serial link (RSL) or controller area network (CAN) techniques. Each of the communication modules 42 provides information to the DMM 46 regarding the condition of the associated lock 40. The communication modules 42 also provide information regarding their location so that the DMM 46 can determine which of the hoistway doors is open in the event that at least one of them is open.

Whenever at least one of the hoistway doors is open, it is necessary to determine whether movement of one or both elevator cars should be prevented. In this example, the DMM 46 controls a relay switching arrangement 50. This example includes a first relay switch 52 associated with a first elevator car controller 54, which is the upper car controller (UCC) in this example. A second relay switch 56 is associated with a second elevator car controller 58, which is the lower car controller (LCC) in this example. The DMM 46 independently controls the relay switches 52 and 56 for purposes of controlling movement of the corresponding elevator car 22 or 24 depending on the status of the doors along the hoistway 26 and the positions of the cars 22, 24.

The DMM 46 is configured to determine whenever there is an open door based upon an indication from one of the communication modules 42. The DMM 46 also determines whether one of the elevator cars 22 or 24 is located at a landing corresponding to the open door. In that case, that car should be prevented from moving and the corresponding switch within the relay arrangement 50 is moved into an appropriate operative state (e.g., opening the relay contacts) to provide an indication to the corresponding controller 54 or 58 to prevent movement of that elevator car. In the illustrated example, the door 30 is open because the lower elevator car 24 is positioned at that landing for servicing passengers. The DMM 46 determines that the door 30 is open and that the elevator car 24 is at that landing. The DMM 46 then controls operation of the relay switch 56 so that the LCC 58 receives an indication to prevent movement of the elevator car 24.

One feature of the illustrated example is that it allows for an elevator car controller that is designed to detect an open relay along a safety chain to be used without altering the configuration of the controller. For example, the LCC 58 is designed to detect when there is an open relay switch corresponding to an open door along the hoistway 26. In the illustrated example, the LCC 58 receives such an indication when the relay switch 56 is opened by the DMM 46. This allows for realizing a two car system without requiring a different or redesigned car controller.

Similarly the UCC 54 detects when the relay switch 52 is in an operative state corresponding to an open door (e.g., the contacts of the relay switch 52 are opened by the DMM 46). In the example of FIG. 1, the upper elevator car 22 is moving between landings and is not positioned near any open doors. It is desirable under such circumstances to allow the upper car 22 to continue moving to provide the intended passenger service, which requires movement of the elevator car 22. In the illustrated example, the DMM 46 keeps the relay switch 52 closed so that the UCC 54 controls movement of the elevator car 22 to allow it to continue to move even though one of the hoistway doors 30 is open.

As can be appreciated from the illustrated example, the DMM 46 allows for independently controlling movement of the elevator cars 22 and 24 even though a hoistway door is open. There will be some circumstances where both elevator cars 22 and 24 should be prevented from moving. For example, if one of the door lock switches 40 indicates that the corresponding door is open and the DMM 46 determines that neither elevator car 22 or 24 is at a landing associated with that door, then both elevator cars 22 and 24 are prevented from moving. Under such circumstances, the DMM 46 places both relay switches 52 and 56 into an operative state that provides an indication to the UCC 54 and the LCC 58 that their corresponding car should be prevented from moving. This may occur during a maintenance operation, for example, where authorized personnel opens a hoistway door and requires access to the hoistway. It is desirable to prevent any elevator car movement under such circumstances without the express intention of the maintenance personnel as known In the example of FIG. 1, the DMM 46 obtains information regarding the position of each elevator car for purposes of determining whether one of the cars is at a position corresponding to an open door. This example includes an elevator car position indicator 60 that is fixed along the hoistway. In one example, the position indicator comprises a steel tape that is positioned along or near one of the guide rails used for facilitating movement of the elevator cars. In this example, the upper elevator car 22 includes a plurality of detectors 62 and 64 that are supported for movement with the car. The lower elevator car 24 includes a plurality of detectors 66 and 68 that are supported for movement with that car. The detectors 66-68 detect an indication from the elevator car position indicator 60 based upon a non-repeating indication along the position indicator 60, which provides information regarding the position of the elevator car. The detectors 62-68 provide a corresponding signal to the DMM 46 regarding the current position of the corresponding elevator car.

A plurality of detectors is included with each elevator car in this example so that the position detected by each can be cross-checked to confirm an accurate position indication. In the event that the information gathered by the plurality of detectors on a particular elevator car does not correspond in a desired manner, the DMM 46 controls the relay arrangement 50 to prevent movement of that elevator car. In some circumstances, the DMM 46 will control the relay arrangement 50 to prevent movement of both elevator cars until the discrepancy can be resolved. Maintaining accurate elevator car position information facilitates smooth operation and the ability to allow one elevator car to continue moving even though another elevator car is stopped where a door is open.

In one example, the position indicator 60 comprises a steel tape including a plurality of perforations 70 that establish a non-repeating gray code of position data along the indicator 60. In one example, the detectors 62-68 comprise optical readers that communicate serially over the traveling cable (not illustrated) to provide appropriate information to the DMM 46. In one example, the detectors 62-68 also determine velocity information, which is useful for elevator control purposes.

The illustrated example includes redundancy that is schematically illustrated. For instance, this example has dual DMMs 46 and 46' that communicate with each other as a means of cross-checking To have suitable redundancy, the illustrated example includes redundant door lock switches 40 and 40' at each door, redundant communications modules 42 and 42', redundant communication links 44 and 44', redundant first relay switches 52 and 52' and redundant second relay switches 56 and 56'.

The dual-redundancy of the illustrated example provides the same functionality twice. That is, the illustrated components (e.g., the door lock switches 40 and 40', the communications modules 42 and 42', the relay arrangements 50 and 50' and the DMMs 46 and 46') perform identical functions in parallel. Additionally, the dual-redundancy allows for cross-checking between the DMMs 46 and 46'.

The DMM 46 and the DMM 46' in this example are both configured to perform the same determinations regarding how to control the relay arrangements 50 and 50' respectively, for purposes of controlling movement of the elevator cars. The example DMMs communicate with each other to cross-check the determinations made by each. In the event that a determination made by one of the DMMs does not coincide with a corresponding determination made by the other, an error is indicated and the elevator system is temporarily taken out of service until the DMMs 46 or another portion of the control arrangement can be serviced. Providing more than one DMM allows for satisfying the type of elevator codes that require redundancy of elevator control devices. Additionally, more than one DMM allows for cross-checking the determinations made by each to facilitate more reliable elevator movement control.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A device for controlling movement of a plurality of elevator cars in a single hoistway, comprising:

a single safety chain including a plurality of communication modules each situated to determine when a respective hoistway door is open;

a single door monitor module that receives at least one indication from at least one of the communication modules that determines that its respective hoistway door is open; and a relay module including a first relay for controlling whether a first elevator car can move in the hoistway and a second relay for controlling whether a second elevator car can move in the hoistway, the door monitor module controlling an operative condition of the first and second relays;

wherein the door monitor module is configured to determine a position of each of the plurality of elevator cars;

determine a condition of each of a plurality of doors along the hoistway based on indications from the single safety chain;

determine when at least one of the doors along the hoistway is open based on the at least one indication from the at least one of the communication modules; and place the first relay in a selected operative state to prevent movement of the first elevator car if the first elevator car is stopped at a landing corresponding to the at least one open door, or place the second relay in a selected operative state to prevent movement of the second elevator car if the second elevator car is stopped at a landing corresponding to the at least one open door, or place the first and second relays into the selected operative state if neither of the first or second elevator car is stopped at a landing corresponding to the at least one open door.

2. The device of claim 1, comprising a first controller configured to prevent movement of the first elevator car responsive to the operative state of the first relay; and a second controller configured to prevent movement of the second elevator car responsive to the operative state of the second relay.

3. The device of claim 1, comprising a door lock switch associated with each door along the hoistway and wherein the door monitor module determines when at least one of the doors is open responsive to an indication from a corresponding one of the door lock switches.

4. The device of claim 3, wherein each communication module receives the indication from the associated door lock switch and provides the door monitor module with an indication of a state of the associated door lock switch and an indication of a location of the associated door lock switch.

5. The device of claim 1, wherein the selected operative state of the relays comprises an open contact of a relay switch.

6. The device of claim 1, comprising a second monitor module configured the same as the door monitor module and wherein the door monitor module and the second monitor module communicate with each other such that if a determination made by one of the modules does not match a corresponding determination made by the other of the modules, then at least one of the modules places the first and second relays into the selected operative state.

7. The device of claim 1, comprising:

an elevator car position indicator fixed along the hoistway that provides a non-repeating indication unique to each position along the hoistway;

at least one detector associated with each elevator car in the hoistway that detects the indication from the position indicator and provides a corresponding signal to the door monitor module.

8. The device of claim 7, wherein the elevator car position indicator comprises an elongated member comprising a continuous and non-repeating gray code along a length of the member.

9. The device of claim 8, wherein the elongated member comprises a steel tape.

10. The device of claim 8, wherein the gray code comprises perforations in the elongated member that provide an indication of position information.

11. The device of claim 8, wherein each detector is programmed to read the code, to determine a corresponding position of the associated elevator car and to provide the signal including an indication of the determined position.

12. The device of claim 11, wherein each detector comprises an optical reader.

13. The device of claim 7, comprising a plurality of the detectors associated with each of the elevator cars, respectively, and wherein one of the elevator cars is prevented from moving if position determinations made by the associated detectors do not indicate the same car position.

14. The device of claim 1, comprising a first controller configured to prevent movement of the first elevator car responsive to the operative state of the first relay, the first controller having a single input coupled with the first relay; and a second controller configured to prevent movement of the second elevator car responsive to the operative state of the second relay, the second controller having a single input coupled with the second relay.

* * * * *